United States Patent [19]

Diffrient

[11] 4,380,352

[45] Apr. 19, 1983

[54] RECLINING CHAIR

[75] Inventor: Niels Diffrient, New York, N.Y.

[73] Assignee: Knoll International, Inc., New York, N.Y.

[21] Appl. No.: 192,377

[22] Filed: Sep. 30, 1980

Related U.S. Application Data

[63] Continuation-in-part of Ser. No. 47,120, Jun. 11, 1979, abandoned.

[51] Int. Cl.[3] ..... A47C 1/02

[52] U.S. Cl. ..... 297/61; 297/88; 297/301; 297/312

[58] Field of Search ..... 297/61, 68, 83, 84, 297/85, 88, 284, 301, 302, 457, 456, 312, 201

[56] References Cited

U.S. PATENT DOCUMENTS

| | | | |
|---|---|---|---|
| 267,748 | 11/1882 | Hartley | 297/61 |
| 276,687 | 5/1883 | Hartley | 297/61 |
| 337,521 | 3/1886 | Scarlett | 297/61 |
| 366,514 | 7/1887 | Scarritt et al. | 297/61 |
| 369,558 | 9/1887 | Scarritt et al. | 297/61 |
| 1,881,136 | 10/1932 | Schmidt | 297/201 |
| 3,215,168 | 11/1965 | Swenson et al. | 297/284 |
| 3,446,532 | 5/1969 | Cramer | 297/312 |
| 3,550,953 | 12/1970 | Neale | 297/201 |
| 3,883,173 | 5/1975 | Shephard et al. | 297/201 |
| 4,153,294 | 5/1979 | Meiller et al. | 297/284 |

FOREIGN PATENT DOCUMENTS

| | | | |
|---|---|---|---|
| 2733744 | 2/1979 | Fed. Rep. of Germany | 297/284 |

*Primary Examiner*—James T. McCall

*Attorney, Agent, or Firm*—Robert Scobey

[57] ABSTRACT

A reclining chair includes a seat including a rearward portion pivoted for reclining of the chair and a backrest having an upper portion linked to the seat for pivotal motion therewith. The necessary linkage is provided by rigid arm portions of the chair, and the seat and backrest include load-bearing diaphragms conforming to the user's body during the full range of motion of the chair.

16 Claims, 9 Drawing Figures

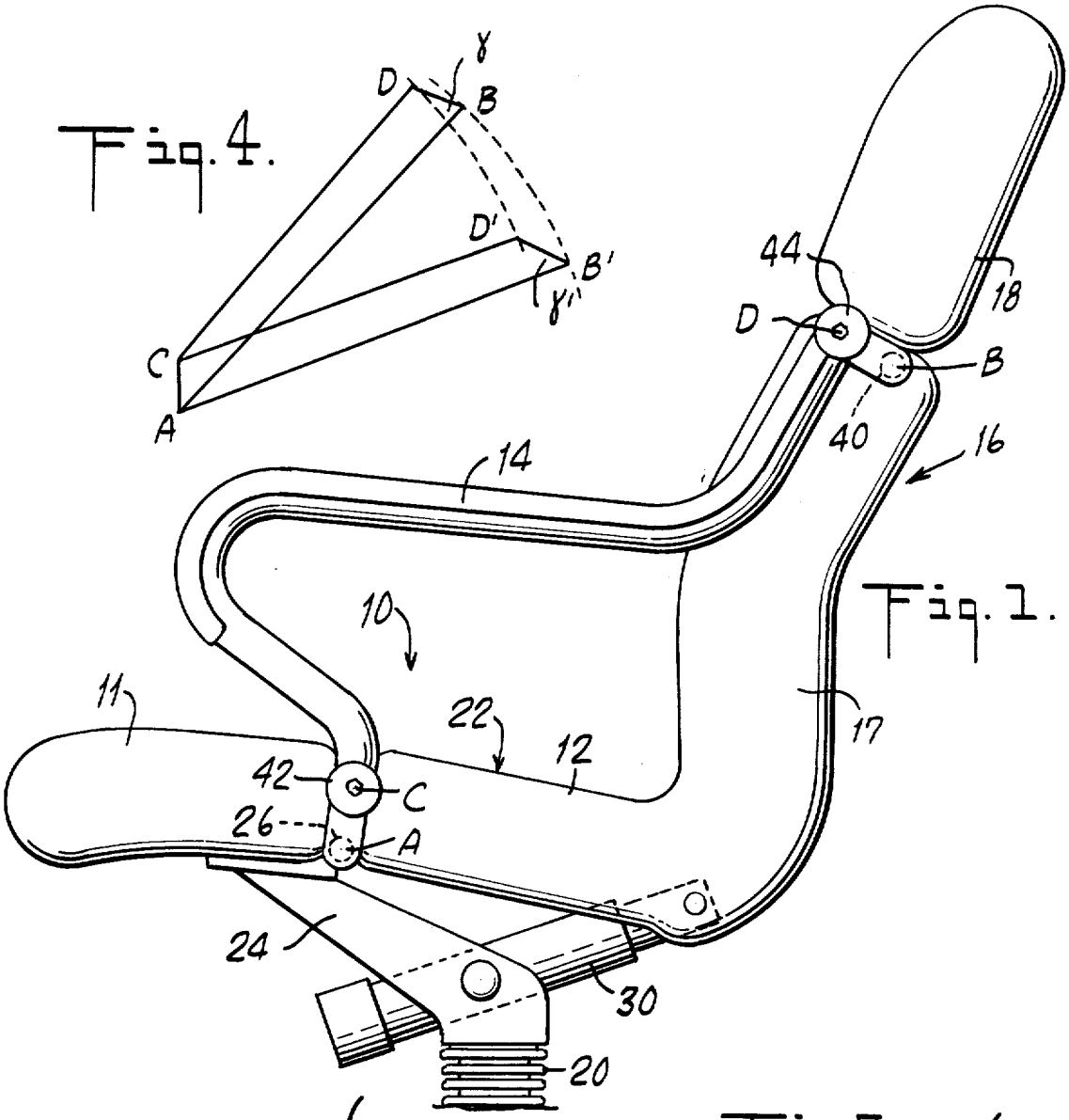
Fig. 4.
D
γ
B
D'
B'
γ'
C
A
44
18
D
B
40
16
14
10
Fig. 1.
11
22
12
17
42
C
26
A
24
30
20
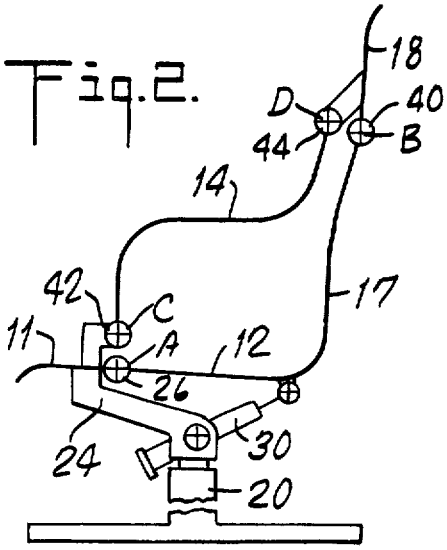
Fig. 2.
18
D
40
44
B
14
42
C
17
11
A
12
26
24
30
20
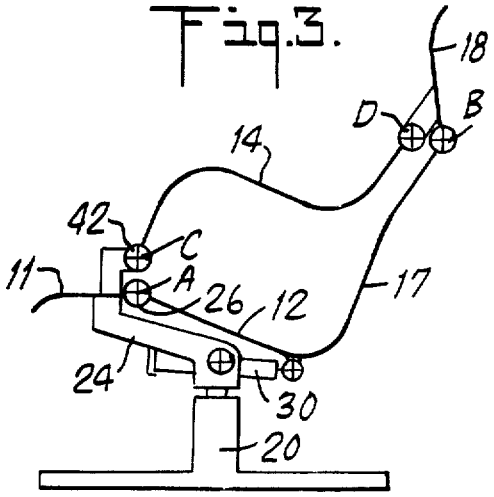
Fig. 3.
18
D
B
14
42
C
11
A
26
12
17
24
30
20

RECLINING CHAIR

This application is a continuation-in-part of my copending application Ser. No. 47,120 filed June 11, 1979, now abandoned.

The present invention relates to reclining chairs and, more particularly, to such chairs which can be reclined quite easily and are comfortable throughout their entire range of motion.

Chairs which may be reclined by the user shifting his weight rearwardly are known and typically include a seat divided into two portions including a forward portion for supporting a user's thighs and a rearward portion articulated thereto. Further, such chairs have a backrest which often is also divided into two portions to include a lower portion held for movement with the rearward portion of the seat, and an upper portion adapted to pivot forwardly when the seat is reclined for supporting the user's shoulders.

It is preferred that the upper portion of the backrest be moved in unison with the reclining seat, and typically a plurality of links are provided for interconnecting the seat to the upper portion of the backrest. Typically, the chair includes arms and these arms are often used as the necessary links, to thereby simplify construction. Unfortunately, however, the arms must often be divided into pivotal segments and thus their shape and orientation relative to one another will change during movement of the chair. Consequently, the optimum shape of the arms for comfort and appearance cannot always be maintained during the full range of motion of the chair.

Further, the pivoted portions of the seat and backrest often fail to support the user comfortably throughout the full range of motion of the chair. As the seat is reclined, the forward portion of the seat is typically held stationery beneath the user's thighs and the pivoted connection with the rearward portion of the seat often forms an angle which bears harshly against the underside of the user's legs. Similarly, the forward motion of the upper portion of the backrest often lifts the user's back from continuous contact with the backrest, particularly near the pivotal connection between the two portions of the backrest.

It is thus a principal object of the present invention to provide a reclining chair giving enhanced comfort to the user during its full range of motion.

It is another object of the present invention to provide arms for such a chair which can serve as links causing an articulated seat portion and an articulated backrest to move in unison without any appreciable change in the shape of the arms.

A further object of the present invention is to provide such a reclining chair which supports the user continuously and comfortably throughout its full range of motion.

A reclining chair according to the present invention includes a seat having a forward portion and a rearward portion articulated thereto. A backrest is provided which has a lower portion held to the rearward portion of the seat for movement in unison therewith, and an upper portion connected pivotally with the lower portion. A pair of arms are provided on respective sides of the chair and each includes a forward end portion held pivotally in position adjacent to the forward portion of the seat, and a rearward end portion held pivotally to the upper portion of the backrest so that the arms may be substantially rigid along their length and yet still serve as links pivoting the upper portion of the backrest forwardly during reclining movement of the rearward portion of the seat.

In preferred form, the forward and rearward portions of the seat are pivoted along a first axis, and the forward end portions of the arms are held for pivotal movement about an axis parallel to and spaced from the first axis. Further, the upper and lower portions of the backrest are likewise pivoted along a second axis, and the rearward portions of the arms are pivoted along an axis parallel to and spaced from this second axis.

As a further feature of the present invention, one or both of the seat and backrest are formed by respective frames defining a central opening and including a load-bearing diaphragm held to the respective frame and spanning the opening thereof.

The diaphragm serves to provide appropriate support for the user and forms a smooth compound curve under the user to support him comfortably.

Further objects, features and advantages of the present invention will be apparent from the detailed description hereinafter set forth, together with the accompanying drawings; in which FIG. 1 is a side elevational view illustrating a chair according to the present invention;

FIG. 2 is a diagrammatic view of the chair of FIG. 1, showing the seat in upright position;

FIG. 3 is a diagrammatic view similar to FIG. 2 but showing the seat in reclined position;

FIG. 4 is a diagram illustrating the arm and upper backrest linkage of the chair of FIG. 1;

Figure 5:
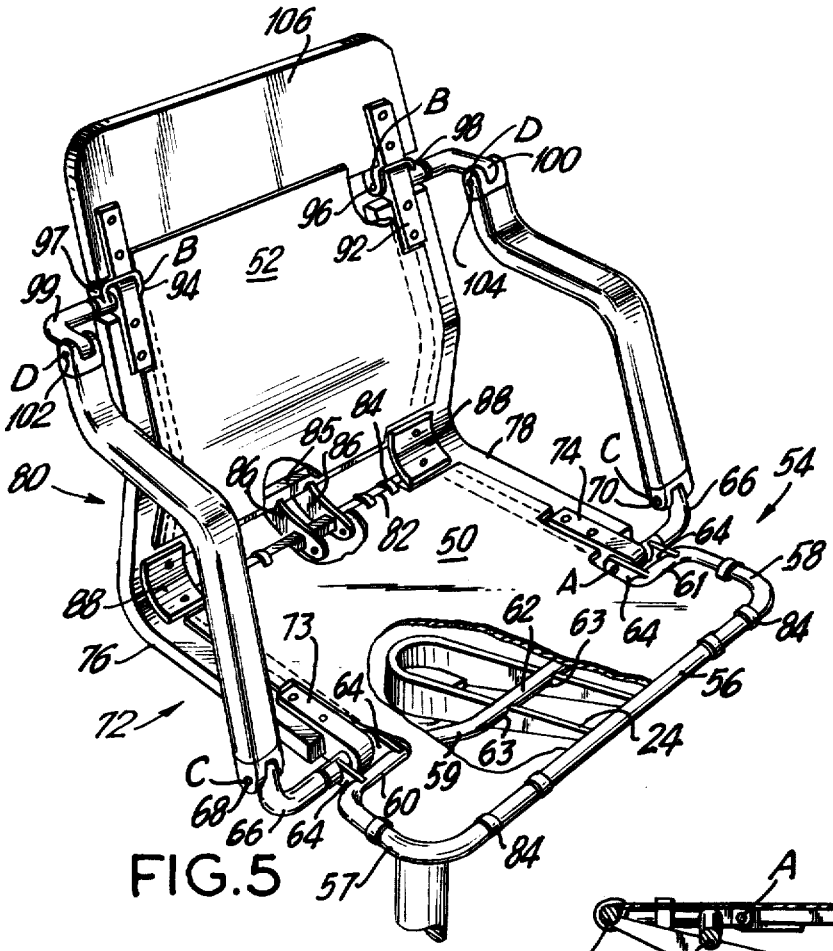
FIG. 5 is a simplified perspective view of a chair forming an illustrated embodiment of the present invention, with the upholstery removed to illustrate features of construction of the seat and backrest in accordance with the present invention.

FIG. 1 illustrates the present invention generally and includes a chair comprising a seat 10 having a forward portion 11 and a rearward portion 12; a pair of rigid armrests 14 respectively disposed on opposite sides of the chair; and a backrest 16 including a lower portion 17 and an upper portion 18, all supported on a base illustrated as being in the form of an upstanding columnar pedestal 20. The rearward seat portion 12 and the lower backrest portion 17 together constitute a unitary, effectively integral contoured structure having a rigid frame preferably surrounded externally by upholstery. The forward seat portion 11 and the upper backrest portion 18 are also upholstered frames, while each of the armrests 14 is a unitary rigid member which may be padded on its upper, arm-engaging surface. The base 20 can be arranged in the conventional manner to permit the chair to swivel about a vertical axis and/or to enable adjustment of elevation of the chair as a whole, but for purposes of description of the present invention the base may be considered as fixed or stationary, since these modes of base motion or adjustment are not relevant to the present invention.

The seat 10 is disposed and adapted to serve the usual function of a seat in supporting a seated occupant of the chair, while the backrest 16, extending upwardly from the rear of the seat, provides support for the occupant's back. As hereinafter further described, the rearward seat portion 12 and lower backrest portion 17 are movable as a unit about a first horizontal axis A located at the forward end of the seat portion 12.

The forward seat portion 11 is fixed in position relative to the base 20, at essentially the same elevation above the floor as the front end of the rear seat portion 12, for supporting the occupant's thighs in both the upright and tilted positions of the seat. Because the tilting axis A is at the front of the rearward seat portion 12, the elevation of the front edge of the rearward seat portion does not change substantially as the seat reclines; but remains in proper positional relationship to the seat portion 11 throughout the full angular ranage of motion of the seat. The upper backrest portion 18 is articulated relative to the seat member, as hereinafter further described, so as to tilt forwardly into a position for supporting the occupant's shoulders and upper back as the seat reclines. The rearward portion 12 of the seat element 10 is so shaped and disposed that when the portion 12 is in its upright position, the weight of an occupant seated upright acts thereon at a locality 22 thereof, disposed somewhat rearwardly of the tilting axis A.

The chair base includes a rigid load-bearing support member 24 mounted on the top of the pedestal 20 and extending diagonally forwardly and upwardly therefrom to the location of the tilting axis A. The rearward seat portion 12 is pivotally connected at its front end to the upper extremity of the support member 24 by a first pivot 26 so as to be supported forwardly by member 24 and pivotable relative thereto about axis A, which is the axis of rotation of the pivot 26. The diagonal arm configuration of the member 24 permits unobstructed movement of the seat member between the upright and reclined positions. Means shown as a spring cylinder 30, having its respective end portions connected pivotally to the support member 24 and the rear of the seat portion 12 directly but yieldably support the rear of the seat and exert thereon a tilt-resisting force. The cylinder acts to stably support the chair in upright position when the occupant is upright, and upon a rearward shift of the occupant's weight, to permit rearward tilting at a smoothly controlled rate, as well as to restore the seat to upright position when the occupant's weight shifts forwardly.

The forward seat portion 11 is fixedly mounted on the upper end of the base support member 24, immediately forwardly of seat position 12. The upper backrest portion 18 is connected to the upper end of the lower backrest portion 17, on opposite sides of the chair, by pivots 40, so as to be tiltable relative to the lower backrest portion about a second axis B, parallel to axis A.

In accordance with one feature of the present invention, the forward end portion of the armrests 14 are connected to the base support member 24 by pivots 42 so that the armrests are pivotable relative to the support member 24 about a third axis C, which preferably is disposed vertically above and parallel to the seat tilting axis A and is fixedly spaced from the axis A. The rearward ends of the armrests are connected to the upper backrest portion 18 by pivots 44, for pivotal movement of the armrests relative to backrest portion 18 about a fourth axis D which is disposed forwardly of, and parallel to, the axis B, and is fixedly spaced from the axis B.

Considering particularly FIGS. 2, 3 and 4, it will be seen that axes A and B are fixedly spaced apart from each other, owing to the rigidity of the integral body constituted of the rearward seat portion 12 and the lower backrest portion 17. Similarly, axes C and D are fixedly spaced apart from each other owing to the rigidity of the unitary armrests 14. Moreover, because of the above-defined relative disposition of these four axes, the radius of rotation of axis B about axis A (line AB, in FIG. 4) is greater than the radius of rotation of axis D about axis C (line CD, in FIG. 4). Because pivots 26 and 42 are both connected to the support member 24, the line AC remains fixed in vertical position at all positions of the seat and backrest, while line AB, CD, and BD all undergo change in angular orientation during movement of the seat.

More specifically, when the rearward seat portion 12 and lower backrest portion 17 are in the upright position of FIG. 2, the upper backrest portion 18 is at the rearward (clockwise) limit of its range of motion relative to the portion 17, and the relative disposition of the four axes is as shown at ABCD in FIG. 4, the angle DBA having the value $\gamma$. Reclining of the seat portion 12 and backrest portion 17 to the FIG. 3 position moves the axis B to the location B' in FIG. 4, tilting the armrests until axis D reaches position D', with concomitant reduction in angle AB'D' now having the reduced value $\gamma'$. This action results in forward tilting motion of the backrest portion 18 relative to the backrest portion 17, i.e. to the forwardly tilted position of FIG. 3, as desired for proper support of the reclining occupant's upper back and shoulders. The above-described geometrical features provide this articulated movement of the backrest portion 18 using rigid, unitary armrest members as the linkage, thereby avoiding the need for intermediate pivots in the armrests or for separate linkage apart from the armrests.

Details of construction of a chair according to the present invention are illustrated in FIGS. 5–9. As shown clearly in FIG. 5, the seat 10 and backrest 16 are formed by rigid peripheral frames each defining an open area covered by respective diaphragms 50 and 52. The diaphragms are held to the respective frame to span the opening thereof and are formed of a resilient material which can support the load of a user's weight. Nylon-reinforced vinyl sheet may be used, but die-stamped sheets of polypropylene are preferred, or any suitable material with similar properties.

As illustrated in FIG. 5, the frame for the seat 10 includes a forward frame portion 54 formed by rigid tubing and including a front leg 56 fixed to the forward end of the support member 24. Extending rearwardly from the front leg 56 are respective side legs 57 and 58 leading to rear leg 59. Rear leg 59 has its outer end portions 60 and 61 in the same plane as the front leg 56 and the side legs 57 and 58, but its central portion 62 extends downwardly to fit within receiving notches 63 formed in the side wall of the support member 24. In this way, the forward frame portion 54 is held quite securely to the support member 24 and yet the area defined by the frame is essentially unobstructed.

The arms 14 of the chair are held pivotally to the forward frame portion 54. As shown in FIG. 5, the outer end portions 60 and 61 of the rear leg 59 have respective pairs of spaced lugs 64 fixed thereto and extending rearwardly. These pairs of lugs 64 each hold a respective crank arm 66. The crank arms 66 are held securely to the lugs 64 and extend upwardly to ends connected pivotally at 68 and 70 to the lower ends of a respective arm 14. Further, as shown in FIG. 5, respective pivot blocks 73 and 74 are connected pivotally to each crank arm and held between the legs of a respective pair. The pivot blocks 73 and 74 are connected to a rearward frame portion 72. Consequently, the pivotal connections 68 and 70 extend along the axis C described above with reference to FIG. 1, and the pivotal connection of the pivot blocks to the crank arms extend along the axis A.

The rearward frame portion 72 includes two rigid side elements 76 and 78 fixed to the respective pivot blocks and extending upwardly to also form the side elements of a frame portion 80 of the backrest.

The side elements 76 and 78 may be formed of wood. The rearward frame portion 72 also includes a rear bar 82 having a non-circular cross section.

The forward frame portion 54 and rearward frame portion 72 together define a common, articulated frame for the seat 10. This common frame defines a central open area spanned by the load-bearing diaphragm 50. As illustrated in FIG. 5, the diaphragm 50 is preferably held to the forward frame portion 54 and the rear bar 82 by rings 84 and is stapled securely or otherwise attached to the side elements 76 and 78. When a user is seated in the chair, his weight is supported by the diaphragm 50 and transmitted to the base 20. It will be well understood, that the diaphragm 50 may be covered or encased by suitable upholstery which may itself be secured to the frame.

The frame portion 80 of the backrest is made integral with the rearward frame portion 72 of the seat by the common side elements 76 and 78. Additionally, a lower bar 85 of non-circular cross section is disposed adjacent the rear bar 82, and rigid connecting elements 86 are fixed securely therebetween. Further, reinforcing members 88 are secured to both the rear bar 82 and lower bar 85 to integrate the rearward frame portion and backrest frame further.

Fitted to the upper ends of each side element 76 and 78 are respective pivot blocks 90 and 92. These pivot blocks 90 and 92 are connected pivotally at 94 and 96 to respective U-shaped members 97 and 98. These U-shaped members are integral with respective crank arms 99 and 100 each extending to a pivotal connection 102 and 104 with the upper portions of respective arms 14.

The top surface of each U-shaped member 97 and 98 is held securely to upper frame element 106. Consequently, the pivotal connections at 94 and 96 constitute the axis B as defined with reference to FIG. 1; and the connections 102 and 104 define the axis D.

The frame portion 80 is thus articulated and defines a central area. This central area is spanned by diaphragm 52 which is similar to diaphragm 50, and, preferably, is covered by suitable upholstery. Diaphragm 52 is stapled or otherwise attached to the side elements 76 and 78 and overlaps and lies against the upper frame element 106 and lower bar 85. The diaphragm 52 is free to slide over the upper frame element 106 as it is tilted forwardly.

Figure 6:
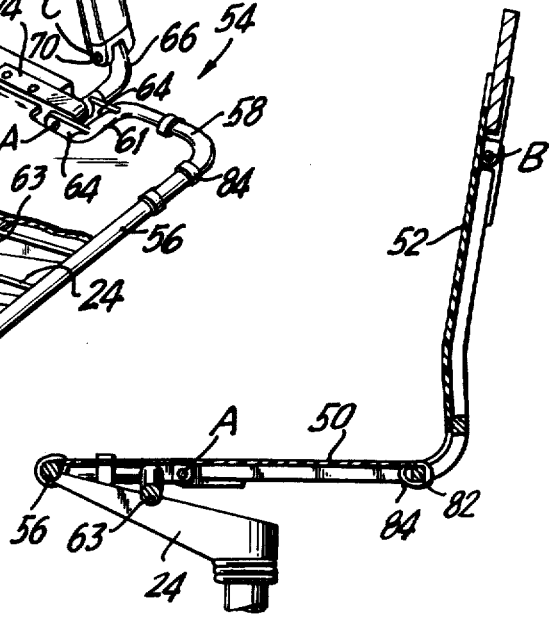
FIG. 6 is a schematic side sectional view of the structure of FIG. 5 with the seat and backrest in the upright position.

The operating characteristics of the diaphragms may be explained by reference to the schematic showings of FIGS. 6–8. When the chair is in the upright position, the diaphragms are in a first configuration, shown in FIG. 6, as essentially planar. It will be understood that while the diaphragms are mounted to their respective frames so as to be reasonably taut and free from overall sag, they need not be completely free from sag when not loaded.

Upon reclining of the chair, the rearward frame portion 72 pivots relative the forward frame portion 54 about the axis A. The front and rear margins of the diaphragm 50 are connected to the front leg 56 and the rear bar 82 by the rings 84 which preferably are flexible cable ties free to rotate or slide along the respective leg or bar.

Figure 8:
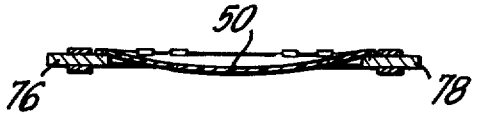
FIG. 8 is a sectional view taken along the line 8—8 of FIG. 7.
Figure 7:
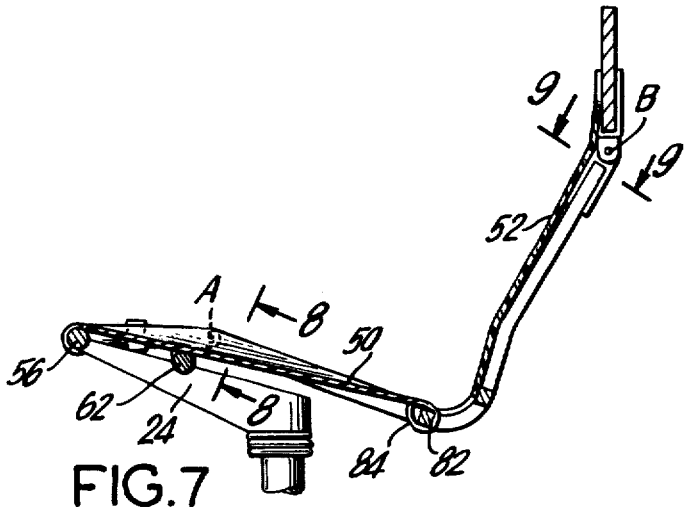
FIG. 7 is a view similar to FIG. 6 with the seat and backrest in the reclined position.

The diaphragm thus seeks a configuration corresponding to the shortest distance beween the front leg 56 and rear bar 82 at the tilted position, while the lateral restraint on the diaphragm caused by the attachment of its side margins to side elements 76 and 78 both forwardly and rearwardly of axis A modifies this configuration, imparting to the diaphragm the complex curvature schematically represented in longitudinal cross section in FIG. 7 and transverse cross section in FIG. 8. The significant feature of this diaphragm configuration is that the central portion of the diaphragm is generally dish-shaped and spaced below the apex of the angle of tilting about axis A. Thus the central diaphragm portion conforms more closely to the configuration of an occupant's thighs than does the angularly tilted frame. Thereby, the diaphragm enhances desired support of the occupant in the tilted position and avoids the discomfort of a sharp angle under the thighs.

Figure 9:
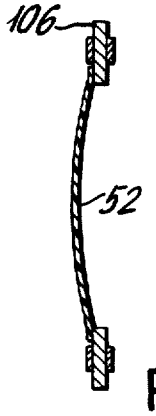
FIG. 9 is a sectional view taken along the line 9—9 of FIG. 7.

In a similar manner, the diaphragm 52 forms a compound curve conforming to the user's back as the upper frame element 106 tilts forwardly, as illustrated in FIGS. 7 and 9.

Consequently, as described above, a chair according to the present invention includes load-bearing diaphragms which conform closely to the user's body surface during movement of the chair, and the user is thus supported comfortably throughout the full range of motion of the chair.

I claim:

1. An articulated chair or the like, comprising:

(a) a base;

(b) a seat element, supported on the base, having a forward portion and a rearward portion tiltable about a first, horizontal axis relative to the forward portion;

(c) a backrest element, supported on the seat, having a lower portion tiltable relative to the base about said first axis and an upper portion tiltable relative to the lower portion about a second axis parallel to the first axis; and (d) a pair of unitary rigid armrests respectively disposed on opposite sides of said seat;

wherein the improvement comprises:

(e) each of said armrests having a forward end portion connected to said base for pivotal movement relative thereto about a third axis spaced from and parallel to said first axis and a rearward end connected to said upper backrest portion for pivotal movement relative thereto about a fourth axis spaced from and parallel to the second axis, such that said armrests constitute a linkage for tilting the backrest upper portion forwardly relative to the backrest lower portion upon rearward tilting movement of the backrest lower portion relative to the base, and (f) the seat and backrest elements each comprising (i) a peripheral frame divided, along the axis of tilting of one portion of the element relative to the other portion of the element, into two rigid frame parts pivotable relative to each other about the last-mentioned axis and cooperatively surrounding a central area of the element extending through the locality of the last-mentioned axis;

(ii) a flexible load-bearing diaphragm extending substantially entirely over said area and fastened to said frame, such that when the one portion of the element is tilted relative to the other, the central portion of the diaphragm assumes a compound curved configuration comfortably supporting the user; and (iii) an upholstery body extending over and supported by the diaphragm and the frame.

2. A chair or the like as defined in claim 1, wherein the front portion of said seat element is fixedly mounted on said base and the lower portion of said backrest element is fixedly secured to the rear portion of said seat element.

3. An articulated chair or the like, comprising:

(a) a base; and (b) a seat element, supported on the base, having a front portion and a rear portion tiltable about a first, horizontal axis relative to the front portion;

wherein the improvement comprises:

(c) the seat element comprising (i) a peripheral frame divided, along the axis of tilting of one portion of the element relative to the other portion of the element, into two rigid frame parts pivotable relative to each other about the last-mentioned axis and cooperatively surrounding a central area of the element extending through the locality of the last-mentioned axis;

(ii) a flexible load-bearing diaphragm extending substantially entirely over said area and fastened to said frame, such that when the one portion of the element is tilted relative to the other, the central portion of the diaphragm assumes a compound curved configuration comfortably supporting the user; and (iii) an upholstery body extending over and supported by the diaphragm and the frame.

4. A chair as defined in claim 1, the diaphragm of said backrest element being held securely to the side portions of its frame but being free to slide along the upper portions thereof.

5. A chair as defined in claim 3, said diaphragm being held securely to side portions of said frame and being held loosely to the front and rear portion of said frame.

6. A chair as defined in either claim 1 or claim 3, the diaphragm of said seat element extending below said first axis in a tilted position of said chair.

7. A reclining chair including a seat having a rearward portion and a forward portion connected pivotally thereto, a backrest having a lower portion held to the rearward portion of said seat for movement in unison therewith and an upper portion connected pivotally to said lower portion, and a pair of arms each located on respective sides of said chair and including a forward end portion held pivotally in position adjacent the forward portion of said seat and a rearward end portion held pivotally to the upper portion of said backrest, said arms being substantially rigid along their lengths and serving as links pivoting the upper portion of said backrest forwardly during reclining of the rearward portion of said seat.

8. A chair according to claim 7, said forward and rearward portions of said seat being pivotal along a first axis, and said forward end portions of said arms being held for pivotal movement about an axis parallel to and spaced from said first axis.

9. A chair according to claim 8, said axis of the pivotal connection of said arms being spaced vertically above said first axis.

10. A chair according to claim 8, said upper and lower portions of said backrest being pivotal along a second axis, and said rearward end portions of said arms being held for pivotal movement about an axis parallel to and spaced from said second axis.

11. A chair according to claim 10, said axis of the pivotal connection of the rearward end portions of said arms being spaced forwardly and above said second axis.

12. A chair according to any of claims 7, 8 or 10, said forward and rearward portions of said seat being formed by a common frame defining a central opening, and a load-bearing diaphragm held to said frame and spanning said central opening.

13. A chair according to claim 12, said diaphragm being held securely to side portions of said frame and being held loosely to the front and rear portions of said frame.

14. A chair according to claim 12, said diaphragm extending below the pivotal connection of said forward and rearward portions of the seat when the chair is reclined.

15. A chair according to claim 12, said upper and lower portions of said backrest being formed by a common frame defining an opening, and a load-bearing diaphragm held to said frame and spanning said opening.

16. A chair according to claim 15, the diaphragm of said backrest being held securely to side portions of said frame but free to slide along the upper portion thereof.

* * * * *